US005720105A

United States Patent [19]

Gates

[11] Patent Number: 5,720,105

[45] Date of Patent: Feb. 24, 1998

[54] UTILITY KNIFE WITH MULTI-PURPOSE BLADE

[75] Inventor: Byron E. Gates, Glencoe, Ill.

[73] Assignee: Better Tools, Inc., Roseville, Minn.

[21] Appl. No.: 114,481

[22] Filed: Aug. 31, 1993

[51] Int. Cl.[6] ..... B26B 9/00; B26B 1/08

[52] U.S. Cl. ..... 30/353; 30/2; 30/162; 30/314; 30/345

[58] Field of Search ..... 30/162, 163, 335, 30/336, 346.57, 346.61, 351, 353, 357, 136, 142, 143, 146, 147, 148, 149, 314, 355, 340, 315, 317, 320, DIG. 8, 280, 294, 346.53, 345, 2; 76/104.1; D7/649, 650, 651

[56] References Cited

U.S. PATENT DOCUMENTS

| | | | |
|---|---|---|---|
| 40,163 | 10/1863 | Fitch | 30/DIG. 8 X |
| D. 246,281 | 11/1977 | Ferrara, Jr. | D7/649 |
| D. 330,405 | 10/1992 | Luchak | D7/649 X |
| 334,724 | 1/1886 | Ruekstuhl | 30/314 X |
| 764,064 | 7/1904 | Minter | 30/DIG. 8 X |
| 1,063,436 | 6/1913 | Hanson | 30/DIG. 8 X |
| 1,342,294 | 6/1920 | Madére | 30/142 |
| 2,611,181 | 9/1952 | Coulter | 30/353 X |
| 3,918,158 | 11/1975 | Debski | D7/649 X |
| 4,283,854 | 8/1981 | Austin | 30/340 X |
| 4,316,324 | 2/1982 | Cochran | 30/162 |
| 4,432,138 | 2/1984 | Piccolo, Jr. | 30/DIG. 8 X |
| 4,586,256 | 5/1986 | Weimann | 30/162 |
| 5,093,994 | 3/1992 | Karas | 30/125 |
| 5,107,593 | 4/1992 | Hutchins | 30/346 |
| 5,138,908 | 8/1992 | Raetz et al. | 76/104.1 |

FOREIGN PATENT DOCUMENTS

| | | | |
|---|---|---|---|
| 1218889 | 3/1959 | France | 30/317 |
| 233092 | 2/1986 | Germany | 30/355 |
| 2171628 | 9/1986 | United Kingdom | 30/162 |

OTHER PUBLICATIONS

Stanley Utility Blades packaging, Stanley Tools/Div. of The Stanley Works, copyright 1990.

Wall Stripper Handles & Blades, Techni Edge Manufacturing Corp., undated.

*Primary Examiner*—Rinaldi I. Rada
*Assistant Examiner*—Clark F. Dexter
*Attorney, Agent, or Firm*—John W. Bunch

[57] ABSTRACT

A utility knife (10) incorporates a handle (12) and a multi-purpose blade (14) with multiple sharpened cutting edges (48, 50 and 52) to facilitate making various types of cuts without changing grip, positions, knives, and/or blades.

7 Claims, 1 Drawing Sheet

UTILITY KNIFE WITH MULTI-PURPOSE BLADE

TECHNICAL FIELD

The present invention relates generally to an improved utility knife, and more particularly to a utility knife incorporating a unique multi-purpose blade.

BACKGROUND ART

Various utility knives and blades have been available heretofore. Two of the most popular blades used with such utility knives have been the standard straight blade and the hook blade, both of which are useful to tradesmen. In using such knives, situations often arise where it is necessary to have both types of blades available to complete the task at hand. At the present time there is no single blade that combines the functions of both straight and hook blades. This means that one must either carry two knives with different blades in each, or interrupt work to stop and change blades in the same knife. Both of these solutions can be time consuming and/or expensive.

U.S. Pat. No. 5,093,994 to Karas shows a double-ended retractable knife having two types of blades for selective extension out either end of the knife. This approach avoids the need for separate knives, but still requires separate blades.

In addition to being adapted for only a single purpose, the blades which are currently available usually include only one cutting surface at the end and are generally configured for use by pulling or drawing the knife towards the user. However, the user may be confronted with tasks or situations that require a puncture and/or cut outwardly or away from the user. Such cuts are often required in performing certain roofing repairs or installations. If such a cut is called for, the user must either change positions and/or hold the knife backwards. This can be awkward and sometimes unsafe.

A need has thus arisen for an improved utility knife incorporating a multi-purpose blade with more than one cutting surface on each end in order to avoid the need for separate blades, separate knives, having to change positions to make certain kinds of cuts, etc.

SUMMARY OF INVENTION

The present invention comprises an improved utility knife and multi-purpose blade which overcome the forgoing and other difficulties associated with the prior art. In accordance with the invention, there is provided a utility knife incorporating a unique, multi-purpose blade. In accordance with the preferred construction, the knife includes a slideable blade carrier by which the blade can be selectively positioned by manual actuation between an interior stored position within the handle, and a partially exposed working position extending out one end of the handle. The blade includes three separate sharpened cutting surfaces at each end; a straight edge along one side, a hook edge along the other side, and another intersecting straight edge which provides for punctures and/or cuts with a pushing motion without unnecessary movements or additional knives and blades.

BRIEF DESCRIPTION OF DRAWING

A better understanding of the invention can be had by reference to the following Detailed Description in conjunction with the accompanying Drawing, wherein.

DETAILED DESCRIPTION

Figure 1:
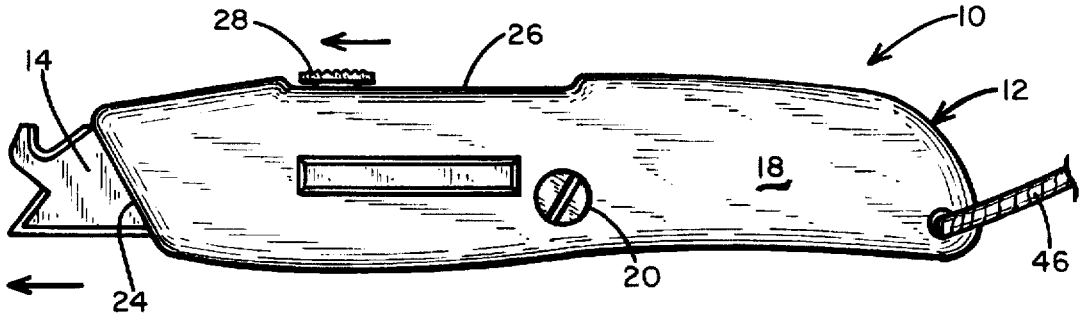
FIG. 1 is a side view of a utility knife incorporating the invention, with the blade shown in an extended working position.
Figure 2:
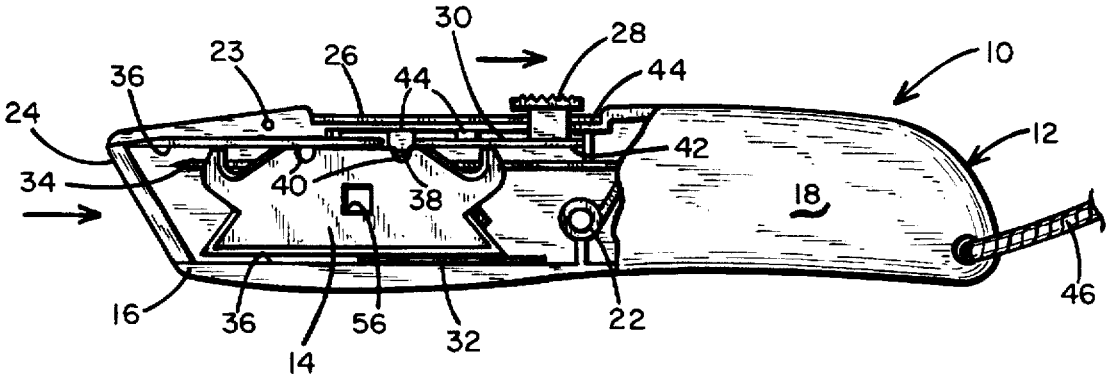
FIG. 2 is a side view (partially cut away) of the utility knife herein with the blade shown in a retracted stored position.

Referring now to the Drawing, wherein like reference numerals designate like or corresponding elements throughout the views, and particularly referring to FIGS. 1 and 2, there is shown a utility knife 10 incorporating the invention. The utility knife 10 generally comprises a handle 12 and a blade 14. The handle 12 is of substantially conventional construction. As will be explained more fully hereinafter, the blade 14 features multiple cutting edges at each end which avoid the drawbacks of the single purpose blades available heretofore.

The handle 12 is of split construction including two mating housing halves 16 and 18 secured together by a screw 20. The screw 20 extends through a hole in the housing half 18 and into engagement with an internally threaded boss 22 on the inside of the other housing half 16. A pin and associated recess 23 are provided on the insides of the housing halves 16 and 18 to facilitate proper location when tightening screw 20. A slot 24 is provided at one end of the handle 12 to accommodate movement of the blade 14 between an extended working position as shown in FIG. 1, and a retracted stored position as shown in FIG. 2.

Another slot 26 is provided along the top of handle 12 to accommodate movement of a releasable thumb button 28 by which manual actuation of the blade 14 is controlled. The thumb button 28 in turn is secured to a spring arm 30 on a slidable blade carrier 32 which is supported and guided by a rail 34 and flanges 36 formed on the insides of the housing halves 16 and 18, as is best seen in FIG. 2. The blade carrier 30 includes a tab 38 that fits into one of the notches 40 on the top edge of the blade 14 to secure it against movement relative to the carrier. Similarly, a pair of opposing detents 42 are provided on the end of spring arm 30 for selective engagement with pairs of opposing, spaced apart notches 44 located along slot 26 in the adjacent housing halves 16 and 18 for purposes of releasably securing the carrier 32 and blade 14 in the desired position. An optional ring or lanyard 46 is provided in a hole in the opposite end of the handle 12 to facilitate carrying or hanging the knife 10.

Figure 3:
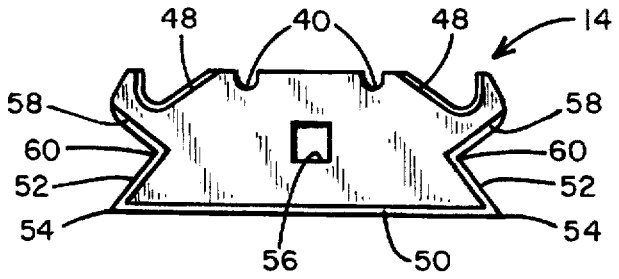
FIG. 3 is an enlarged side view showing the multi-purpose utility knife blade of the invention.

The constructional details of the blade 14 can be seen in FIG. 3. In accordance with the preferred embodiment, the blade 14 includes a top edge with a pair of spaced apart notches 40 therein as discussed above, as well as a sharpened hook-shaped cutting edge 48 therein adjacent each end of the blade. The bottom edge of the blade 14 includes a sharpened straight cutting edge 50 extending continuously between both ends. Each end of blade 14 also includes a sharpened cutting edge 52 which is set at an acute angle relative to the bottom cutting edge 50, intersecting at a sharp outside corner or point 54. For example, the angle between cutting edges 50 and 52 can be about 52 degrees.

This arrangement and combination of cutting surfaces comprises a significant feature of the present invention. It will be appreciated that either the hook-edge 48 or the straight edge 50 can be used simply by turning the knife over and without changing knives or blades. The end cutting edge 52 and intersecting point 54 facilitate punctures and cuts with a pushing motion without changing grip on the knife 12, or changing blades and/or knives.

The blade 14 is preferably formed from heat treated carbon steel of about 0.025 inch thickness.

If desired, an optional square center hole 56 can be provided in the blade 14 to facilitate use in another type of handle, such as in a roofers knife. Also, another sharpened cutting edge 58 can be provided in each end of the blade 14 for additional versatility. The cutting edge 58 intersects the cutting edge 52 to form a notch with a sharp inside corner 60 to complement point 54. The angle between cutting edges 52 and 58 can be about 90 degrees, for example.

Although the blade 14 has been illustrated and described in conjunction with a knife of the retractable type, it will be understood that the blade herein could also be used with other types of knives or handles.

From the foregoing, it will thus be apparent that the present invention comprises an improved utility knife having a multi-purpose blade of unique configuration. In addition to having straight and hook-shaped cutting edges on opposite sides, cutting edges are provided on the ends to facilitate making various kinds of cuts with either pulling or pushing motions, but without changing knives and/or blades. Other advantages will be evident to those skilled in the art.

Although particular embodiments of the invention have been illustrated in the accompanying Drawing and described in the foregoing Detailed Description, it will be understood that the invention is not limited only to the embodiments disclosed, but is intended to embrace any alternatives, equivalents, modifications, and/or rearrangements of elements falling within the scope of the invention as defined by the following Claims.

What is claimed is:

1. A blade for a utility knife, which comprises:

a generally flat blank having a bottom edge, a top edge having at least a portion which extends generally parallel to the bottom edge, and opposite ends;

the bottom edge being sharpened to form a cutting portion extending continuously between both ends of said blank;

the top edge including two sharpened hook-shaped cutting portions, one adjacent each end of said blank; and at least one end of said blank having an inset portion in the general shape of a V-shaped notch formed by top and bottom sides, the bottom side including a sharpened cutting portion intersecting the bottom edge at a predetermined acute angle therebetween.

2. The blade of claim 1, wherein the blank is comprised of heat treated carbon steel.

3. A utility knife blade, which comprises:

a generally flat blank having a straight bottom edge, a top edge, and opposite ends;

the bottom edge including a sharpened cutting portion at least at each end of said blank;

the top edge including a sharpened hook-shaped cutting portion adjacent at least one end of said blank; and each end of said blank having an inset portion in the general shape of a V-shaped notch formed by a top side and a bottom side, the bottom side including a sharpened cutting portion intersecting the sharpened cutting portion of the adjacent bottom edge at a predetermined acute angle therebetween.

4. The utility knife blade of claim 3, wherein the top side of the notch in each end of said blank includes a sharpened cutting portion intersecting the sharpened cutting portion of the bottom side of the respective notch forming a sharp inside corner.

5. The utility knife blade of claim 3, wherein the top and bottom edges of said blank have at least portions which are generally parallel.

6. The utility knife blade according to claim 5, wherein the sharpened cutting portion in the bottom edge extends continuously between the ends of said blank.

7. The utility knife blade of claim 3, wherein the blank is comprised of heat treated carbon steal.

* * * * *